United States Patent [19]

Sander

[11] Patent Number: 4,475,957

[45] Date of Patent: Oct. 9, 1984

[54] COATING COMPOSITION

[75] Inventor: Lothar S. Sander, Princeton, N.J.

[73] Assignee: Amchem Products, Inc., Ambler, Pa.

[21] Appl. No.: 542,860

[22] Filed: Oct. 17, 1983

[51] Int. Cl.[3] ..... C23F 11/04

[52] U.S. Cl. ..... 148/6.16

[58] Field of Search ..... 148/6.16

[56] References Cited

U.S. PATENT DOCUMENTS

| | | | |
|---|---|---|---|
| 3,175,964 | 3/1965 | Watanake | 148/6.16 |
| 3,185,596 | 5/1965 | Schiffman | 148/6.16 |
| 3,450,579 | 6/1969 | Rausch | 148/6.16 |
| 4,183,772 | 1/1980 | Davis | 148/6.16 |
| 4,373,968 | 2/1983 | Hess | 148/6.2 |

*Primary Examiner*—Sam Silverberg

*Attorney, Agent, or Firm*—Ernest G. Szoke; Henry E. Millson, Jr.; Mark A. Greenfield

[57] ABSTRACT

An acidic aqueous no-rinse solution for coating metallic surfaces to make them corrosion resistant containing hexavalent chromium, trivalent chromium, phosphoric acid, and a poly(alkyleneoxy) polymer. Said solution is stable at both high and low temperatures.

20 Claims, No Drawings

COATING COMPOSITION

This invention relates to the treatment of metallic surfaces to improve their resistance to corrosion and to prepare said surfaces to receive siccative coatings, and to compositions useful in such treatments.

BACKGROUND OF THE INVENTION

It is known to coat metallic surfaces with compositions that are effective in forming thereon coatings which are corrosion-resistant in order to protect the surfaces from materials which tend to corrode or otherwise degrade the metal. In general it is desirable that such coatings should also have properties such that any overlying coatings, such as, for example, siccative coatings which are applied thereon, will adhere tightly thereto.

One of the many types of coating compositions that are available for forming on metallic surfaces coatings of the aforementioned type comprises an acidic aqueous coating composition containing hexavalent chromium, reduced (trivalent) chromium, and an acrylic resin. A coating composition of this type is described in U.S. Pat. No. 3,185,596 (the '596 patent). The '596 patent discloses an aqueous acidic composition formulated from:

(i) the reaction product of chromic acid ($CrO_3$) and formaldehyde, a reducing agent used in an amount such that about 40 to about 95% by weight of the chromium remains in the hexavalent state, and (ii) an acrylic resin.

These coating compositions have a high performance level with vinyl type paints but not with the polyester type.

Another composition of the aforementioned type is disclosed in U.S. Pat. No. 4,183,772 (the '772 patent). This composition is formulated from:

(i) hexavalent chromium (as $CrO_3$), about 40 to about 60% by weight of which is in the reduced (trivalent) form;

(ii) phosphoric acid; and (iii) a mixture of:

(a) soluble polyacrylic acid, and (b) dispersed acrylic acid solids.

The coatings formed from the compositions of the '772 patent have the advantage over those of the '596 patent in that they have a high performance level with all types of overlying paints.

Although the compositions disclosed in the '596 and '772 patents can be used to advantage in various types of applications, a problem has been encountered in the use of such compositions when applied to metallic surfaces by an applicator roll. It has been observed that the use of the composition results in an accumulation and an excess buildup of chromium on the applicator roll which can also affect adversely the appearance as well as the functional quality of the coating. Periodic removal of the chromium from the roll is possible but this is time consuming and costly, making the compositions unattractive to the consumer. The inclusion in such composition of an alkylphenoxy-poly (alkyleneoxy)-ether will, according to U.S. Pat. No. 4,373,968, reduce such chromium build-up on the roll. While these compositions of the prior art are useful in providing coatings which are both corrosion resistant and adherent to overlying siccative coatings, there are other problems involved in their use. Since these coatings are used on a large industrial scale they are most often packaged and stored in drums. At low temperature storage conditions the compositions are stable, but at higher temperatures (above 100° F.) a sludge forms on standing. This problem was particularly acute in the summer since the drums, in keeping with common practices, were stored outdoors, and at times the internal temperatures of the drums reached as high as 125° F. The sludge that formed was usually about 8 to 10 inches thick, but in severe cases the sludge reached a thickness of about 24 to about 36 inches. Such compositions could not be used and were returned to the supplier, causing the supplier economic loss.

One solution to this problem was the provision of a 2-package system wherein the hexavalent-trivalent chromium system was in one package and the resin system in another. The packages were shipped in separate containers and the contents mixed prior to use. Although this solved the problem of the sludge it was not particularly appealing to the consumer who had to do the mixing and preferred a composition which was ready for instant use.

It is, accordingly, an object of this invention to provide a composition which is useful in providing a no-rinse coating for metals, which coating is resistant to corrosion and adherent to overlying siccative coatings applied thereon, and which composition remains stable on standing regardless of the storage temperature at which it is kept.

It is a further object of this invention to provide a composition of the type described above which can be prepared and shipped as a single package.

DESCRIPTION OF THE INVENTION

In accordance with this invention there is provided a no-rinse, aqueous, acidic composition which can be applied to metallic surfaces to form coatings thereon which are resistant to corrosion and to which siccative coatings applied thereto are adherent. The composition remains stable when stored at temperaturs as high as 140° F.

The composition comprises in approximate percent by weight:

| | |
|---|---|
| (a) hexavalent chromium as $CrO_3$, about 5 to about 60% of which is in the reduced trivalent form | 0.90–3.0 preferably 0.95–1.41, |
| (b) phosphoric acid (75%) | 0.05–0.3, preferably 0.07–0.12, |
| (c) poly(ethyleneoxy) polymer | 0.03–0.12 |
| (d) water | q.s 100 |

The $CrO_3$ is preferably reduced to the desired extent in situ by the addition of the proper amount of formaldehyde in accordance with the processes described in U.S. Pat. Nos. 3,185,596 and 4,373,968 whose disclosures are incorporated herein by reference.

The poly(ethyleneoxy) polymers useful in the practice of this invention are water-soluble resins of the formula $H-(OCH_2CH_2)_nOH$ wherein n varies from about 2,000 to about 20,000, having molecular weights in the range from about 90,000 to about 900,000. These resins are commercially available under the name POLYOX resins from Union Carbide Corporation. A preferred resin is POLYOX WSR-205 which has a molecular weight of about 600,000.

Other suitable POLYOX resins include POLYOX-WSR N-10 (m.w. 100,000); -WSR N-80 (m.w. 200,000); -WSR N-750 (m.w. 300,000); -WSR N-3000 (m.w. 400,000); and -WSR-1105 (m.w. 900,000). All these resins are available as 5% aqueous solutions or as dry powders, and can be used either as a solution or in the dry state.

In preparing the compositions of the present invention, the $CrO_3$, in the form of chromic acid, is added to water. The phosphoric acid is then added with stirring. The resulting solution is heated to about 150° F. Next formaldehyde (conveniently in the form of 37% aqueous solution) is added slowly with stirring while maintaining the temperature at about 190°-200° F. The solution is allowed to cool to about 120° F., and any additional water required in the final composition is added. The poly(ethyleneoxy) polymer is added slowly with stirring and the composition is thoroughly mixed. After cooling the solution can be packaged in drums.

Preferably, deionized or distilled water is used to maintain as low a concentration as possible of extraneous salts in the composition.

Concentrated aqueous compositions can also be prepared according to the process given above, and such concentrated compositions are also part of the present invention. The concentrated aqueous compositions of the invention have the following relative composition:

| Ingredient | Parts by weight, approximate |
|---|---|
| hexavalent chromium as $CrO_3$, about 5 to about 60% of which is in the reduced trivalent form | 0.90–3.0 preferably 0.95–1.41, |
| phosphoric acid (75%) | 0.05–0.3, preferably 0.07–0.12, |
| poly(ethyleneoxy) polymer | 0.03–0.12 |

The above concentrated aqueous compositions usually contain at least about 5% by weight, preferably at least about 9% by weight of the partially reduced hexavalent chromium component.

These concentrated aqueous compositions are useful for shipping and storage, and are then diluted with water to form the coating compositions of the invention prior to use thereof.

The invention will be clearer from the description and examples which follow. These examples are given by way of illustration and are not to be regarded as limiting.

EXAMPLE 1

| Ingredient | % Weight |
|---|---|
| $CrO_3$ (45% of which has been reduced to $Cr^{3+}$) | 0.95 |
| $H_3PO_4$ (75%) | 0.08 |
| POLYOX WSR-205 (as a 5% aqueous solution) - dry weight | 0.04 |
| Water | q.s. 100 |

The above composition was prepared in accordance with the procedure given below:

102 g of $CrO_3$ as chromic acid was dissolved in 931 g of water. 8.4 g of phosphoric acid (75%) was added with stirring. The chromic acid/phosphoric acid solution was heated to 150° F. Formaldehyde (37% solution) was added over a period of 65 minutes with stirring, while maintaining the temperature at 190°-200° F. The resulting solution was then heated for 2 hours at 190°-200° F. The heating was discontinued and the solution allowed to cool to 120° F. The specific gravity of the solution was adjusted to about 1.074 by addition of water. Next, POLYOX WSR-205 was added slowly with stirring. The resulting mixture was mixed for 20 minutes, and then diluted with water to a 10% concentration to give the above composition.

Following the procedure of EXAMPLE 1 using the required quantities of ingredients, the following additional compositions were prepared.

EXAMPLE 2

| Ingredient | % Weight |
|---|---|
| $CrO_3$ (40% of which has been reduced to $Cr^{3+}$) | 0.7 |
| $H_3PO_4$ (75%) | 0.11 |
| POLYOX WSR-205 (as a 5% aqueous solution) - dry weight | 0.06 |
| Water | q.s. 100 |

EXAMPLE 3

| Ingredient | % Weight |
|---|---|
| $CrO_3$ (60% of which has been reduced to $Cr^{3+}$) | 1.41 |
| $H_3PO_4$ (75%) | 0.12 |
| POLYOX WSR N-750 (dry powder) | 0.06 |
| Water | q.s. 100 |

EXAMPLE 4

| Ingredient | % Weight |
|---|---|
| $CrO_3$ (50% of which has been reduced to $Cr^{3+}$) | 0.95 |
| $H_3PO_4$ (75%) | 0.07 |
| POLYOX WSR N-10 (dry powder) | 0.06 |
| Water | q.s. 100 |

EXAMPLE 5

| Ingredient | % Weight |
|---|---|
| $CrO_3$ (10% of which has been reduced to $Cr^{3+}$) | 1.30 |
| $H_3PO_4$ (75%) | 0.14 |
| POLYOX WSR-1105 (dry powder) | 0.03 |
| Water | q.s. 100 |

EXAMPLE 6

| Ingredient | % Weight |
|---|---|
| $CrO_3$ (5% of which has been reduced to $Cr^{3+}$) | 1.20 |
| $H_3PO_4$ (75%) | 0.15 |
| POLYOX WSR-205 (dry powder) | 0.06 |
| Water | q.s. 100 |

EXAMPLE 7

| Ingredient | % Weight |
|---|---|
| $CrO_3$ (15% of which has been reduced to $Cr^{3+}$) | 1.00 |
| $H_3PO_4$ (75%) | 0.11 |

-continued

| Ingredient | % Weight |
|---|---|
| POLYOX WSR-205 (dry powder) | 0.05 |
| Water | q.s. 100 |

The compositions of EXAMPLES 1 to 7 were subjected to stability tests under different temperatures. Samples of the compositions of these examples were kept at 140° F. for 3 months. No sludge formation occurred, nor were there any problems at lower temperatures. Samples which were exposed to 5 freeze-thaw cycles still retained their desirable coating properties.

Unlike the compositions of the prior art which contain acrylic resins, the compositions of this invention can be diluted to high dilutions without affecting their stability. For example, samples of the compositions of EXAMPLES 1 to 7 were diluted to below 8% v/v and remained stable. At such higher dilutions, compositions containing acrylic resins were unstable, exhibiting flocculation.

The compositions of this invention can be applied to the metallic surface in any suitable manner, such as, for example, roll coating, brushing, spraying, and dipping. Preferably, roll coating is used. The compositions exhibit excellent surface wetting, better flow-out and less ribbing. Metals on which the composition can be effectively applied include aluminum, hot dipped galvanized steel, cold roll steel, and the like. In particular, the application of the compositions of this invention using a Giordano Strip Coater showed improved wetting and flow-out without the ribbing noted in the prior art compositions.

The coatings of the compositions of this invention on various metals had excellent adhesion to all types of metal paints such as Wyandotte-Polyester, Lilly Blue Polyester, PPG-Duracron 630 High Gloss (an acrylic), Glidden Polyure White (a polyester), PPG-Duracron 630 Super Polar White Acrylic, and the like. The painted metals which had previously been coated with the novel compositions of this invention gave good results when subjected to corrosion tests and physical tests such as adhesion, reverse impact, pencil hardness, and cross hatch tests.

What is claimed is:

1. A no-rinse metal pretreatment composition for corrosion resistance comprising in approximate percent by weight:

| | |
|---|---|
| $CrO_3$, about 5 to about 60% of which is in the reduced trivalent form of Cr | 0.90–3.0 |
| phosphoric acid (75%) | 0.05–0.3 |
| poly(ethyleneoxy) polymer of the structure $H\text{-}(\text{-}OCH_2CH_2\text{-})_n\text{-}OH$, wherein n varies from about 2,000 to about 20,000, having a molecular weight of about 90,000 to about 900,000 | 0.03–0.12 |
| water | q.s. 100 |

2. A composition according to claim 1 wherein about 40 to about 60% of the $CrO_3$ is in the reduced trivalent form of Cr.

3. A composition according to claim 2 wherein the molecular weight of the poly(ethyleneoxy) polymer is about 600,000.

4. A composition according to claim 2 wherein the molecular weight of the poly(ethyleneoxy) polymer is about 100,000.

5. A composition according to claim 2 wherein the molecular weight of the poly(ethyleneoxy) polymer is about 900,000.

6. A composition according to claim 3 wherein the weight percent of $CrO_3$ is about 0.95 to about 1.41.

7. A composition according to claim 1 wherein the weight percent of phosphoric acid is about 0.07 to about 0.12.

8. A process for providing a corrosion resistant coating to a metallic surface comprising contacting the surface with the composition of claim 1.

9. A process for providing a corrosion resistant coating to a metallic surface comprising contacting the surface with the composition of claim 2.

10. A process for providing a corrosion resistant coating to a metallic surface comprising contacting the surface with the composition of claim 3.

11. A process for providing a corrosion resistant coating to a metallic surface comprising contacting the surface with the composition of claim 4.

12. A process for providing a corrosion resistant coating to a metallic surface comprising contacting the surface with the composition of claim 5.

13. A process according to claim 8 wherein the composition is applied to the metallic surface with an applicator roll.

14. A concentrated aqueous composition consisting essentially of the following:

| Component | Parts by weight, approximate |
|---|---|
| (a) hexavalent chromium as $CrO_3$, about 5 to about 60% of which is in the reduced trivalent form | 0.90–3.0 |
| (b) phosphoric acid (75%) | 0.05–0.3 |
| (c) poly(ethyleneoxy)polymer of the structure $H\text{-}(\text{-}OCH_2CH_2\text{-})_n\text{-}OH$, | 0.03–0.12 |

wherein n varies from about 2,000 to about 20,000 having a molecular weight of about 90,000 to about 900,000; and wherein component (a) is present in at least about 5% by weight of the concentrated composition.

15. A concentrated aqueous composition in accordance with claim 14 wherein component (a) is present in at least about 9% by weight of the composition.

16. A concentrated aqueous composition in accordance with claim 15 wherein component (a) is present in from about 0.95 to about 1.41 parts by weight, and component (b) is present in from about 0.07 to about 0.12 parts by weight.

17. A concentrated aqueous composition according to claim 15 wherein in component (a) about 40 to about 60% of the $CrO_3$ is in the reduced trivalent form of Cr.

18. A concentrated aqueous composition according to claim 15 wherein the molecular weight of the poly(ethyleneoxy) polymer in (c) is about 600,000.

19. A concentrated aqueous composition according to claim 15 wherein the molecular weight of the poly(ethyleneoxy) polymer in (c) is about 100,000.

20. A concentrated aqueous composition according to claim 15 wherein the molecular weight of the poly(ethyleneoxy) polymer in (c) is about 900,000.

* * * * *